US010981262B2

(12) United States Patent
Kassouf

(10) Patent No.: US 10,981,262 B2
(45) Date of Patent: Apr. 20, 2021

(54) WRENCH WITH THREADED END BITS

(71) Applicant: Snap-on Incorporated, Kenosha, WI (US)

(72) Inventor: Thomas L. Kassouf, Port Washington, WI (US)

(73) Assignee: Snap-on Incorporated, Kenosha, WI (US)

( * ) Notice: Subject to any disclaimer, the term of this patent is extended or adjusted under 35 U.S.C. 154(b) by 109 days.

(21) Appl. No.: 15/953,054

(22) Filed: Apr. 13, 2018

(65) Prior Publication Data

US 2018/0326562 A1 Nov. 15, 2018

Related U.S. Application Data

(60) Provisional application No. 62/504,882, filed on May 11, 2017.

(51) Int. Cl.
*B25B 15/00* (2006.01)
*B25B 23/00* (2006.01)

(52) U.S. Cl.
CPC ..... *B25B 15/002* (2013.01); *B25B 15/008* (2013.01); *B25B 23/0035* (2013.01)

(58) Field of Classification Search
CPC ... B25B 15/002; B25B 15/008; B25B 15/001; B25B 23/0035; B25B 23/0007; B25G 3/30
USPC ..... 81/52, 436, 438, 442, 445, 459
See application file for complete search history.

(56) References Cited

U.S. PATENT DOCUMENTS 1,057,101 A * 3/1913 Wachter ..... B25B 23/0035 81/438
2,797,599 A * 7/1957 McGarvie, Jr. ..... B25B 15/008 81/58.3
3,393,722 A * 7/1968 Windham ..... B25B 15/002 81/438
3,733,937 A * 5/1973 Mezey ..... B25B 15/008 81/448
5,704,261 A * 1/1998 Strauch ..... B25B 15/001 81/467
5,927,165 A * 7/1999 Vasudeva ..... B25B 23/108 81/442
7,040,202 B2 * 5/2006 Hsien ..... B25B 15/008 81/443

(Continued)

FOREIGN PATENT DOCUMENTS

CN 2065971 11/1990
CN 203109853 8/2013

(Continued)

OTHER PUBLICATIONS

Wikipedia, Screw Threads, Dec. 10, 2015, Wikipedia.org, p. 2, http://en.wikipedia.org/wiki/Screw_thread (Year: 2015).*

(Continued)

*Primary Examiner* — Orlando E Aviles
*Assistant Examiner* — Robert F Neibaur
(74) *Attorney, Agent, or Firm* — Seyfarth Shaw LLP

(57) ABSTRACT

An Allen™-key style wrench that has tips at the working ends of the wrench that are composed of a different material than the body of the wrench. The body include internally-threaded bores at each end, mated to the external threads of bits providing the tips.

5 Claims, 1 Drawing Sheet

(56) References Cited

U.S. PATENT DOCUMENTS

| | | | | |
|---|---|---|---|---|
| 7,059,222 | B2 * | 6/2006 | Hsien | B25B 15/008 81/443 |
| 7,140,281 | B1 | 11/2006 | Ruff | |
| 9,061,401 | B2 * | 6/2015 | Lin | B25B 15/001 |
| 9,409,286 | B2 * | 8/2016 | Hsu | B25B 15/008 |
| 2005/0193877 | A1 | 9/2005 | Maznicki | |
| 2008/0098862 | A1 | 5/2008 | Hsieh | |
| 2014/0102265 | A1 * | 4/2014 | Looijen | B25B 15/005 81/445 |
| 2014/0366688 | A1 * | 12/2014 | Bocanegra Marquina | B25D 1/02 81/25 |
| 2016/0271766 | A1 * | 9/2016 | Chen | B25B 15/008 |
| 2016/0311106 | A1 | 10/2016 | Chuang | |

FOREIGN PATENT DOCUMENTS

| | | |
|---|---|---|
| CN | 203611187 | 5/2014 |
| CN | 203901175 | 10/2014 |
| CN | 205674085 | 11/2016 |
| EP | 1512498 | 3/2005 |
| GB | 353322 | 7/1931 |
| JP | S5580185 | 6/1980 |
| TW | 356438 | 4/1999 |
| TW | M353802 | 4/2009 |
| TW | M434657 | 8/2012 |

OTHER PUBLICATIONS

Australian Examination Report No. 1 for Application No. 2018202776 dated Feb. 22, 2019, 3 pages.

United Kingdom Combined Search and Examination Report for Application No. GB1806641.5, dated Oct. 18, 2018, 6 pages.

United Kingdom Examination Report for Application No. GB1806641.5 dated Jun. 25, 2019, 3 pages.

Canadian Office Action for Application No. 3,004,027 dated Jun. 6, 2019, 3 pages.

Taiwan Office Action for Application No. 107115870 dated Dec. 20, 2018, 4 pages.

Chinese Office Action for Application No. 201810438282.1, dated Aug. 14, 2019, 7 pages.

Examination Report. No. 1 for Application No. 2020203713 dated Mar. 4, 2021, 7 pages.

* cited by examiner

WRENCH WITH THREADED END BITS

CROSS-REFERENCE TO RELATED APPLICATIONS

This application claims priority to U.S. Provisional Patent Application No. 62/504,882, entitled Allen Wrench, filed May 11, 2017, the contents of which are incorporated by reference herein in their entirety.

TECHNICAL FIELD OF THE INVENTION

The presently disclosed embodiments relate generally to wrenches. More particularly, the presently disclosed embodiments relate to hex keys, also known as hex wrenches, Allen™ wrenches, and Allen™ keys with threaded end bits.

BACKGROUND OF THE INVENTION

Hex keys, also known as hex wrenches, Allen™ wrenches, and Allen™ keys have hexagonal cross-sections, and come in inch and metric dimensions. They are used to drive workpieces such as bolts and screws that have a hexagonal socket in their head.

Hex keys are typically produced by shearing and bending a metal wire that has a hexagonal cross section to form a one-piece key. There are tradeoffs between the weight of a hex key, its durability, and its cost. While the keys can be produced using relatively light, cheap material, the tips at the working ends of such keys can strip when over-torqued. In comparison, when made from materials that produce more durable tips, the weight and cost of the key can be considerably higher. Another consideration is the resilience of the material to twisting, since materials that produce durable ends may result in the body of the key snapping or permanently twisting when over-torqued.

SUMMARY OF THE INVENTION

The present application discloses a hex key that has a body made of a first material, and end bits made of a second material that is different from the first material. Each end of the key body has a bore that is internally threaded. The end bits include a hexagonal tip at one end, and external threads that mate with the threaded bores of the key body at the other end. By independently selecting the first and second materials, a more durable key can be constructed, while simplifying the trade-offs associated with material selection for conventional keys.

In an embodiment, a hex key includes a body having an L-shape and first and second working-ends, and wherein the body is made of a first material. A first tip is disposed at the first working-end, and a second tip disposed at the second working-end. Further, the first and second tips may be composed of a second material different than the first material.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
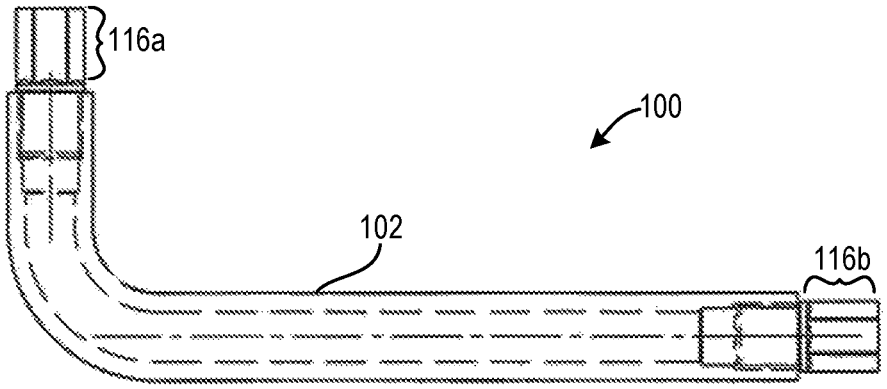
FIG. 1 is an assembled view of a hex key according to at least some of the presently disclosed embodiments.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present application discloses a hex key that has a body made of a first material, and end bits made of a second material that is different from the first material. Each end of the body has a bore that is internally threaded. The end bits include a hexagonal tip at one end, and external threads that mate with the threaded bores of the body at the other end. By independently selecting the first and second materials, a more durable key can be constructed, while simplifying the trade-offs associated with material selection for conventional keys.

As shown in FIGS. 1-5, a hex key 100 may include a body 102, a first tip 116*a* at one working end, and a second tip 116*b* at the other working end. The body 102 is made of a first material, and the tips 116*a*/116*b* are made of a second material different than the first material.

Figure 2:
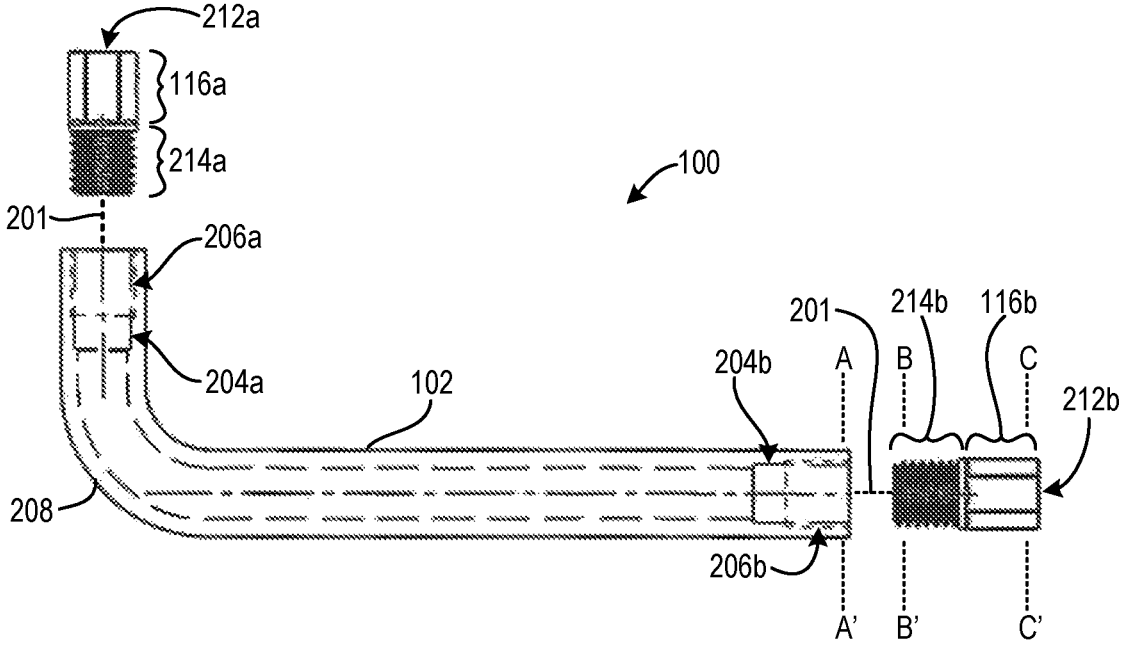
FIG. 2 is a disassembled view of the hex key illustrated in FIG. 1.
Figure 3:
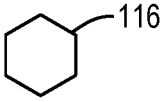
FIG. 3 is a cross-sectional view along the plane C-C' of the hex key illustrated in FIG. 2.
Figure 4:
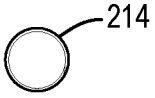
FIG. 4 is a cross-sectional view along the plane B-B' of the hex key illustrated in FIG. 2.
Figure 5:
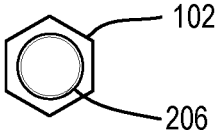
FIG. 5 is a cross-sectional view along the plane A-A' of the hex key illustrated in FIG. 2.

As illustrated in FIG. 2, the body 102 includes a bend 208, where a long axis 201 of the body 102 turns approximately ninety (90) degrees, providing the body 102 with an "L" shape. At a first working end, the body 102 includes a first bore hole 204*a* that is concentric around the long axis 201, and which contains internal threads 206*a*. At a second working end, the body 102 includes a second bore hole 204*b* that is also concentric around the long axis 201, and which contains internal threads 206*b*.

The first tip 116*a* is part of a first bit 212*a* coupled to the first working-end of the body 102, and the second tip 116*b* is part of a second bit 212*b* coupled to the second working-end of the body 102. As illustrated in FIG. 2, the first bit 212*a* has external threads 214*a* at one end, and the second bit 212*b* has external threads 214*b* at one end. The external threads 214*a* of the first tip 212*a* mate with the internal threads 206*a* of the first bore hole 204*a*, and the external threads 214*b* of the second tip 212*b* mate with the internal threads 206*b* of the second bore hole 204*b*.

The spiral helix of the internal and external threads can twist in two possible directions, which is sometimes referred to as "handedness." Threads can be right-handed or left-handed, depending upon whether a clockwise or counter-clockwise turn is required to couple and uncouple internal and external threads.

The internal threads 206*a*/206*b* of the first and second bore holes 204*a*/204*b*, and the external threads 214*a*/214*b* of the first and second bits 212*a*/212*b* may all twist in a same direction. For example, they may all have right-hand threads, or may all have left-handed threads. As an alternative, the internal threads 206*a* of the first bore hole 204*a* and the external threads 214*a* of the first bit 212*a* may be different from the internal threads of the second bore hole and the external threads of the second working end. For example, the threads at one working end may be right-handed, while the threads at the other working end may be left-handed.

While the key 100 is described as having first and second bore holes 204*a*/204*b* with internal threads 206*a*/206*b*, and first and second bits 212*a*/212*b* with external threads 214*a*/214*b*, the key 100 may have first and second ends with external threads, and first and second bits with bore holes having internal threads.

The keys 100 and/or working ends may be externally marked to indicate whether the working-end is right-handed or left-handed, so as to reduce the risk of uncoupling a bit 212 from the body 102. For example, when the keys 100 are part of a kit provided with something that has hex-socketed workpieces, the body 102 and/or tips 116 may be color-coded to indicate whether the key is for assembly (tightening) or disassembly (loosening).

Optionally, a thread-locking fluid, such as a methacrylate, may be applied to the threads 206 and 214 prior to coupling the bits 212 to the body 102. Should it become necessary to replace a tip 116, the working end of the key 100 can be heated to release the threads.

The body 102 may have a hexagonal cross-section, like the cross-section of the tips 116 and conventional hex keys, or a differently-shaped cross-section may be used. For example, the body 102 may have a round cross-sectional shape.

The mechanical and material considerations used to select the first material for the body 102 are independent of those used to select the second material for the bits 212. Factors such as hardness, ductility, strength, density, and elastic modulus can be separately optimized for the differing roles of the body 102 and the tips 116. For example, for a more durable tip 116, the bits 212 may be made of a material that has a higher hardness than the material used for the body 102. Meanwhile, to moderate the overall weight of the key 100, the material used for the body 102 may be have a lower density (i.e., be lighter) than the material used for the bits 212. Among other things, the body 102 and the bits 212 may be composed of different metals and/or metal alloys.

Although the key 100 is discussed as having tips 116 with hexagonal cross-sections, other shapes may be used, depending upon the type of workpiece to be engaged, such as square tips, tri-wing tips, and Torx™ tips. The working-end of the tips 116 may include a bore hole centered on the long axis 201 for compatibility with "security" workpieces, such as screws with security hex or security Torx™ heads.

From the foregoing, it can be seen that there has been described an improved hex key which is of simple and economical construction, and improved durability and repairability.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object. As used herein, the term "a" or "one" may include one or more items unless specifically stated otherwise.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A hex key, comprising:

a body having an L-shape and first and second working-ends, wherein the body is made of a first material;

a first bit engagable with the first working-end and having:

a first tip portion adapted to engage a first fastener; and a first threaded portion extending from the first tip portion and adapted to threadably engage the first working-end; and a second bit engagable with the second working-end and having:

a second tip portion adapted to engage a second fastener; and a second threaded portion extending from the second tip portion and adapted to threadably engage the second working-end, wherein the first and second bits are composed of a second material that is different than the first material.

2. The hex key of claim 1, wherein the first and second threaded portions respectively include external threads.

3. The hex key of claim 2, wherein:

the first working-end includes a first bore hole that has internal threads, the first threaded portion threadably engages the internal threads of the first bore hole, the second working-end includes a second bore hole that has internal threads, and the second threaded portion threadably engages the internal threads of the second bore hole.

4. The hex key of claim 3, wherein the internal threads of the first and second bore holes, and the external threads of the first and second threaded portions twist in a same rotational direction.

5. The hex key of claim 3, wherein the internal threads of the first bore hole and the external threads of the first threaded portion twist in a direction opposite from the internal threads of the second bore hole and the external threads of the second threaded portion.

* * * * *